US005732311A

United States Patent [19]

May et al.

[11] Patent Number: 5,732,311

[45] Date of Patent: Mar. 24, 1998

[54] COMPLIANT ELECTROGRAPHIC RECORDING MEMBER AND METHOD AND APPARATUS FOR USING SAME

[75] Inventors: John W. May, Rochester; Thomas N. Tombs, Brockport, both of N.Y.

[73] Assignee: Eastman Kodak Company, Rochester, N.Y.

[21] Appl. No.: 773,157

[22] Filed: Dec. 26, 1996

[51] Int. Cl.[6] ..... G03G 15/00; G03G 5/00

[52] U.S. Cl. ..... 399/159; 430/56; 430/60

[58] Field of Search ..... 399/159; 430/56, 430/60, 62, 127, 135

[56] References Cited

U.S. PATENT DOCUMENTS

| | | | |
|---|---|---|---|
| 4,601,963 | 7/1986 | Takahashi et al. | 430/69 |
| 5,084,735 | 1/1992 | Rimai et al. | 399/302 |
| 5,187,526 | 2/1993 | Zaretsky | 399/302 |
| 5,378,564 | 1/1995 | Nakayama et al. | 430/60 X |
| 5,503,953 | 4/1996 | Ito et al. | 430/60 X |

*Primary Examiner*—Matthew S. Smith
*Attorney, Agent, or Firm*—Norman Rushefsky

[57] ABSTRACT

An electrographic primary imaging member upon which an electrographic image may be written includes a support member; a charge retention layer for the electrographic image; a compliant layer being formed on the support member as an intermediate layer between the charge retention layer and the support member, the compliant layer being formed of a material having a Young's modulus of between about 0.1 MPa and about 100 MPa and a thickness of between at least 1 mm and about 20 mm; and the charge retention layer being a dielectric and being substantially thinner than the compliant layer and being supported on the support member and having a Young's modulus of greater than that of the compliant layer and at least about 80 MPa. The imaging member may form part of an electrographic recording apparatus wherein the electrographic image is developed and transferred to a receiver sheet or transferred to an intermediate transfer member from which it is then transferred to a receiver sheet.

27 Claims, 3 Drawing Sheets

COMPLIANT ELECTROGRAPHIC RECORDING MEMBER AND METHOD AND APPARATUS FOR USING SAME

BACKGROUND OF THE INVENTION

1. Field of the Invention

This invention relates to electrography and more particularly to a primary electrographic imaging member and to a method and apparatus of use of this image member in an electrographic recording apparatus.

2. Description Relative to the Prior Art

In electrography, an electrostatic latent image is formed on a dielectric imaging layer (electroreceptor) by various techniques such as by an ion stream (iongraphy), stylus, shaped electrode and the like. Development of the electrostatic latent image may be effected by the application of certain electrostatically charged marking particles or toners in either dry form or dispersed in liquid media. Electrography or electrographic as the terms are used herein are distinguished from electrophotography and electrophotographic respectively in that the former terms do not imply use of a photoconductive member or element as the primary imaging member whereas the latter terms typically do.

In electrographic recording apparatus it would be desirable to transfer the toner efficiently to a wide variety of receivers, including papers having pronounced roughness. Problems in transfer that can arise include halo, hollow character formation and mottle. These typically arise in prior art electrographic recording apparatus and are collectively referred to as transfer artifacts. It would be particularly desirable to improve transfer of developed images comprising toner particles which have relatively small diameters; i.e., those having a volume weighted average particle size less than 9 μm. The transfer of small particles of this size is particularly a problem since the surface forces such as van der Waals forces play a greater factor in inhibiting transfer.

There are various advantages to electrography over conventional electrophotography. These include use of cheaper primary imaging members that are more reliable, and also, because the primary imaging member is not a photoconductor, thermal transfer to a receiver becomes possible which can improve transfer efficiency. In addition the primary imaging member may be formed of a material that is a low surface energy material that facilitates transfer to a receiver sheet of images formed with small toner particles.

From the points of view of cost, machine complexity and machine size, there is a need to provide simpler electrographic technology than used by conventional electrophotography, particularly for high quality color. There is also a need to provide simpler electrographic technology having digitized electronic input and high throughput.

It is therefore an object of the invention to provide an improved primary electrographic image recording medium and method and apparatus for electrographic recording that is particularly suited for transfer of small particles for producing black and white as well as color imaging. It has particular utility for color imaging.

SUMMARY OF THE INVENTION

In accordance with a first aspect of the invention, there is provided an electrographic primary imaging member upon which an electrographic image may be written by a writer, the imaging member comprising a support member; a charge retention layer for the electrographic image; a compliant layer formed on the support member as an intermediate layer between the charge retention layer and the support member, the compliant layer being formed of a material having a Young's modulus of between about 0.1 MPa and about 100 MPa and a thickness of between at least 1 mm and about 20 mm; and the charge retention layer being a dielectric and being substantially thinner than the compliant layer and being supported on the support member and having a Young's modulus of greater than that of the compliant layer and at least about 80 MPa.

In accordance with other aspects of the invention, there are provided an electrographic recording method and apparatus comprising forming an electrostatic latent image on an electrographic primary imaging member, the imaging member including a support member, a charge retention layer for an electrographic image, a compliant layer formed on the support member as an intermediate layer between the charge retention layer and the support member, the compliant layer being formed of a material having a Young's modulus of between about 0.1 MPa and about 100 MPa and a thickness of between at least 1 mm and about 20 mm, the charge retention layer being a dielectric and substantially thinner than the compliant layer and supported on the support member and having a Young's modulus of greater than that of the compliant layer and at least 80 MPa. The electrostatic latent image is developed with toner at a development station and the developed image is transferred from the primary imaging member. The transfer may be to a receiver sheet such as paper or plastic or to an intermediate transfer member which then transfers the image to a receiver sheet.

Other aspects and advantages of the invention will become apparent after considering the drawings and detailed description provided below.

DETAILED DESCRIPTION OF THE PREFERRED EMBODIMENTS

Figure 1:
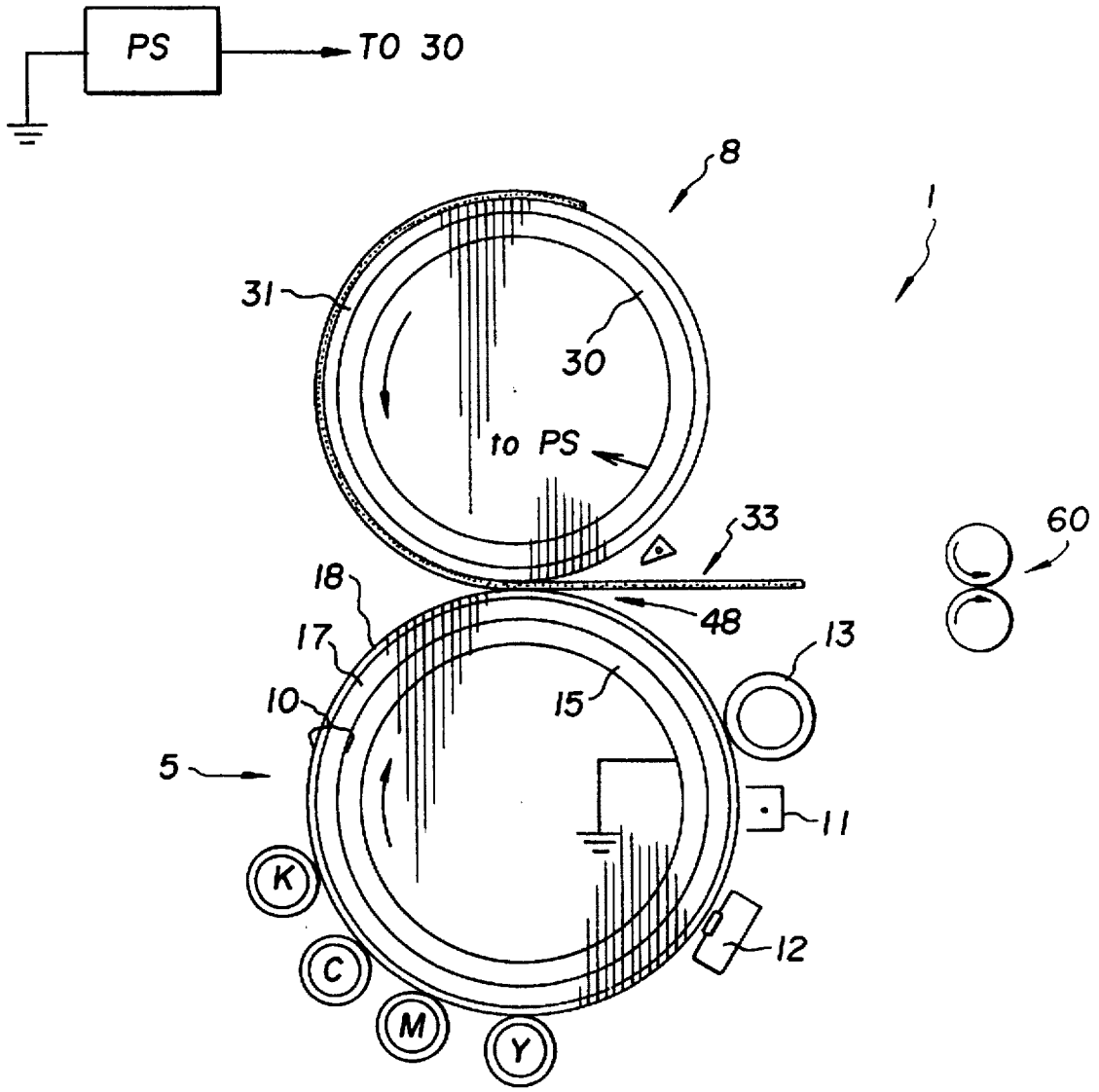
FIG. 1 is a schematic of a multicolor electrographic recording apparatus in accordance with one embodiment of the invention.

With reference to FIG. 1, in accordance with one preferred embodiment of the invention, an electrographic recording apparatus 1 is shown wherein the primary electrographic imaging member 5 is in the form of a write drum 5 and is shown at the bottom, and the receiver support drum or transfer drum 8 (hereinafter referred to as the "transfer member") at the top. However, the relationship may be reversed or one be to the left or right of the other. The primary imaging member 5 may be a write drum (as shown) or a web. The write drum and the transfer member are spaced from each other to form a nip 48 into which a receiver sheet 33 may be moved by suitable means not shown. The write drum 5 comprises a roller 15 having a bi-layer coating 10. The bi-layer coating is made of a relatively thick compliant and conductive first layer 17 which is coated directly on roller 15, and a thin second layer 18 coated atop layer 17. Layer 18 is a dielectric layer that is preferably smooth, tough and flexible. Conductive support roller 15 is preferably grounded and is preferably made of metal. Alternatively, roller 15 may be made of a nonconductor such as glass or plastic on which a conductive electrode layer (not shown, and preferably grounded) has been coated underneath bi-layer 10. Starting at transfer nip 48, the write drum rotates clockwise as shown to a magnetic brush cleaning station 13, which removes residual toner that was not completely transferred to the receiver in transfer nip 48. Other cleaning methods may be employed, such as blade or fur brush cleaning, and may also include use of a pre-clean charger [not shown]. After leaving cleaner 13, any residual charge on the surface of layer 18 is neutralized by an AC charger 11. Thereafter, an electrostatic image, preferably halftone, is deposited by writer 12 directly on the surface of layer 18. Writer 12 is any suitable device for depositing an image-wise or electrostatic latent image charge pattern on a dielectric, including ionographic methods. Data for the writer is provided by a suitable source not shown.

Assume as an example that the writer 12 records on an image area or image frame of the write drum an electrostatic latent image of the color image separation that is to be recorded with black toner, i.e., the black record.

The image area of the write drum under consideration then proceeds to a black (K) toning station, with color toning stations of cyan (C) magenta (M) and yellow (Y) disengaged. Following development, the black toner image is transferred in transfer nip 48 from the surface of layer 18 to a receiver 33, such as paper or plastic. Receiver sheet 33 is held snugly to the surface of a resistive layer 31 coated on the transfer member 8. A typical transfer member will handle standard paper sizes, for example, 12 inch by 18 inch paper, and have a circumference of about 20 inches. For smaller size papers, multiple sheets may be on the transfer member at one time, for example, two 8½"×11" sheets, in this regard reference is made to U.S. Pat. No. 4,712,906. The transfer member comprises an electrically biased metal core 30 coated with a compliant, resistive blanket layer 31. The drives to the write drum and the transfer member cause the surface speeds of the write drum (made of bi-layer 10 and roller 15) and the transfer member 8 (made of layer 31 and roller 30) to be the same. There is no constraint on the ratio of outer diameters of the two drums. Preferably, they are the same size. An electric field urges transfer of the toner in transfer nip 48, and this field is established in the nip by a voltage applied to roller 30 by a suitable power supply PS with roller 15 grounded, and with the polarity of roller 30 opposite to that of the toner. Other transfer apparatus where different potentials are applied in the pre-nip, in-nip and post-nip region may also be used. To create a cyan color separation image, the steps above are repeated, except that the cyan color separation record is recorded and the cyan (C) toning station is engaged or operative for development of the cyan record while stations K, M and Y are disengaged, i.e., non-operational relative to development of electrostatic images on the drum. The developed cyan toner image is transferred to receiver 33 in registry with the black toner image. The entire process is similarly repeated for the magenta (M) and yellow (Y) color separation records, with the appropriate toner station engaged and others disengaged, and the developed magenta and yellow color separations are also transferred to receiver sheet 33. Finally, the receiver sheet is removed from the transfer member by suitable known devices well known in the art and forwarded to a fusing station 60 where the YMCK stack of toners on the receiver sheet 33 is fused, preferably using pressure and elevated temperature (not shown) to form a fixed multicolor or process color image on the receiver. The location of stripping of the sheet 33 from the transfer member need not be at the nip area. The order of development KCMY may be altered as desired, depending for example on specific transfer properties of individual toners. The toning stations are preferably two-component magnetic brush SPD (small particle dry) development stations having a rotating magnetic core wherein hard magnetic carrier particles are flipped in the development zone and cause triboelectrically charged toner particles, of preferably less than 9 μm size and more preferably of about 2 μm to about 6 μm volume weighted average size, to contact and to adhere to the primary imaging member as it moves through the development zone.

The electrical and mechanical properties of the layers 17, 18 and 31 are preferred to be in specified ranges.

Resistive layer 31 of the receiver support drum should have resistivity in the approximate range of about $10^6$ to about $10^{12}$ ohm-cm, and preferably in the range of about $10^8$ to about $10^{11}$ ohm-cm.

The resistivity required for layer 17 of the write drum is determined in part by the spatial frequency of the half-tone image, by the speed of the write drum 5 at the surface of bi-layer 10, and also by the dielectric constant of layer 18, which is extremely thin compared to layer 17. The time $t_w$ in seconds to write each dot of charge in a charge pattern corresponding to a half-tone is given by equation (1).

$$t_w=(fv)^{-1} \tag{1}$$

where f is spatial frequency in dots per inch (dpi) and v is the rotation speed at the surface of bi-layer 10 in inches per second (ips). The dielectric relaxation time, $\tau_{10}$, of the bi-layer structure 10 is given by equation (2), where it is assumed that layer 18 is insulating and also that the capacitance of layer 17 is negligible compared to that of layer 18.

$$\tau_{10}=\rho_{17}K_{18}\epsilon_0(d_{17}/d_{18}) \tag{2}$$

$K_{18}$ and $\rho_{17}$ are respectively the dielectric constant of layer 18 and resistivity of layer 17, $\epsilon_0$ is the permittivity of free space, and $d_{17}$ and $d_{18}$ are the respective thickness of the layers. The condition for discrete writing of non-overlapping dots is given by equation (3).

$$\tau_{10}<<t_w \tag{3}$$

Combining equations (1)–(3) gives the condition (4):

$$\rho_{17}<<[fvK_{18}\epsilon_0(d_{17}/d_{18})]^{-1} \tag{4}$$

For existing toning technology, a reasonable range for v is between about 1 ips and about 20 ips. A reasonable range for f is between about 300 dpi and about 1200 dpi, and $\epsilon_0=8.854\times10^{-14}$ farad per centimeter. Assuming that layer 18 comprises an organic polymeric material, a typical range of values for $K_{18}$ is 3 to 6 (layer 18 is preferably a polyurethane, dielectric constant about 6). The thickness range for layer 18 is about 5 μm to about 50 μm, preferably between about 10 μm and about 30 μm. The thickness range for layer 17 is at least 1 mm to about 20 mm, preferably about 3 mm to about 10 mm. Substituting the extremes of these ranges of values into the right hand side of (4) yields for the upper limit of $\rho_{17}$ the range $3.9\times10^4$ to $6.3\times10^8$ ohm-cm. Using preferred values of the parameters (f=600 dpi, v=10 ips, $K_{18}$=6, $d_{17}$=7 mm, $d_{18}$=20 μm) gives $\rho_{17}$= $9.0\times10^5$ ohm-cm. For a practical system, it may be assumed that each of these upper limit estimates should be reduced by approximately two orders of magnitude, so as to provide adequate response time for minimizing crosstalk between pixels. With the above assumptions, the resistivity $\rho_{17}$ must be no higher than the approximate range $2\times10^2$ to $6\times10^6$ ohm-cm (for the preferred values of the parameters, about $9\times10^3$ ohm-cm).

Turning now to layer 18 itself, it is necessary that the charge pattern laid down by writer 12 not decay significantly during the time $t_d$ between write and develop. This requires that the resistivity of layer 18 be sufficiently high. One may assume that the electric field distribution $E_0$ produced at the writer station relaxes to E at the time of toning according to the relation $$E=E_0 \exp(-t_d/\tau_{18}) \quad (5)$$

where $\tau_{18}$ is the dielectric relaxation time of layer 18, with $$\tau_{18}=\rho_{18}K_{18}\epsilon_0 \quad (6)$$

It is desirable that the field $E_o$ does not substantially decay between write and develop. Therefore, assuming $(E/E_0) \geqq 0.99$ gives from (5), the result $$\tau_{18}\geqq 99.5\ t_d \quad (7)$$

Combining equations (6) and (7) yields $$\rho_{18}\geqq 99.5\ t_d\ (K_{18}\epsilon_0)^{-1} \quad (8)$$

Assuming $K_{18}$=3 to 6, and putting $t_d$ in a reasonable practical range 0.1 to 10 seconds (depending on the geometry of the intended application), one finds the minimum desired resistivity from the right hand side of (8) to be in the range $1.9\times10^{13}$ to $3.7\times10^{15}$ ohm-cm. The assumed insulating character of layer 18 requires also that the breakdown strength be high. The charging process is expected to deposit enough charge to produce a voltage drop across layer 18 of several hundred volts, typically as high as 100V to 600V. For the preferred range of thickness between about 10 μm and about 30 μm, this range of voltage will produce electric fields in the range 3.3 to 60 volts per micron. Preferred low surface energy materials such as fluoropolymers, for example, have very high dielectric strength well in excess of the above requirement.

The materials and mechanical properties of layers 17 and 18 are now considered. The Young's Modulus of the material comprising layer 17 is between about 0.1 MPa (Mega Pascal) and about 100 MPa, preferably between about 0.5 MPa and about 5 MPa. Suitable materials for layer 17 are, for example, polyurethanes, silicone rubbers, and silicone foams. The Young's Modulus of layer 18 is preferably greater than 80 MPa and greater than that of the compliant layer. Materials having a low force of adhesion to toner are preferred. Suitable materials for layer 18 are, for example, sol-gels, oeramers, polyurethanes, polyethylene terephthalates such as Mylar, a registered trademark of E. I. DuPont and Company, polycarbonates such as Lexan, a registered trademark of General Electric, Inc. and fluoropolymers such as Teflon, a registered trademark of E. I. DuPont and Company. Alternatively, release layers or coatings may be used on the outer surface of layer 18 to provide low force of adhesion to toner.

Figure 2:
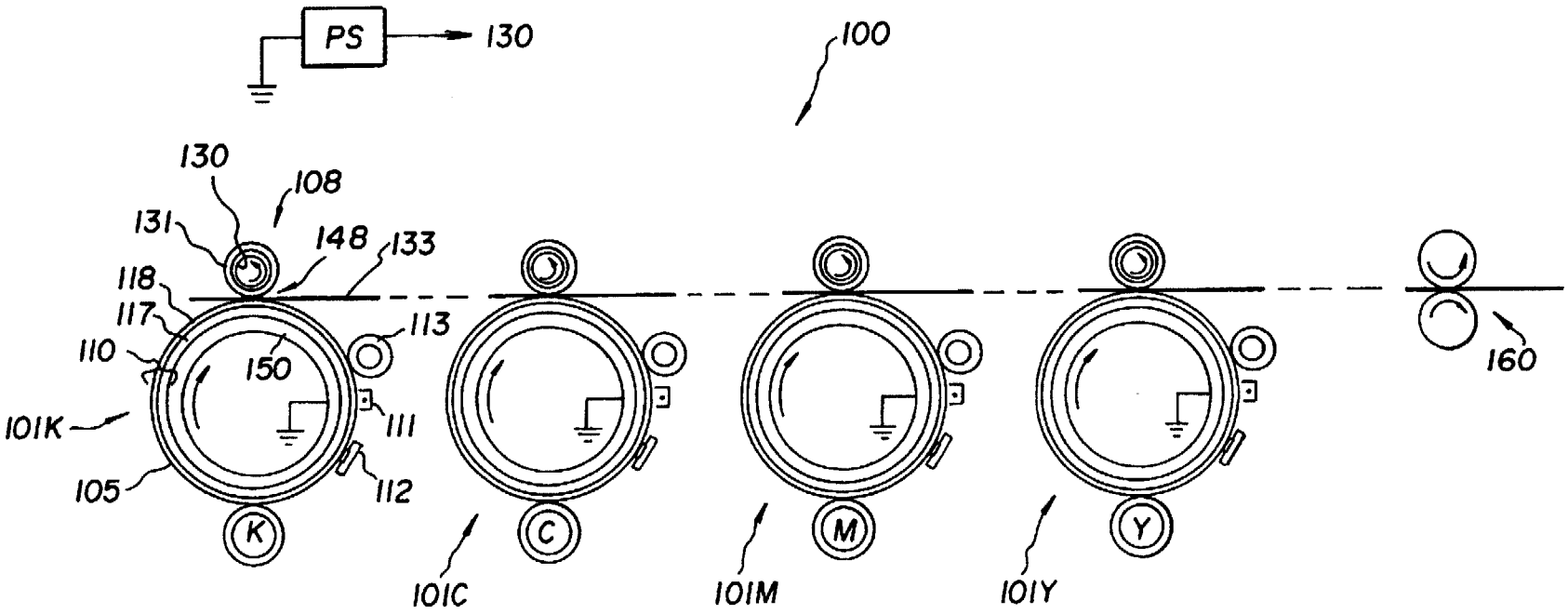
FIG. 2 is a schematic of a second multicolor electrographic recording apparatus in accordance with a second embodiment of the invention.

With reference now to the apparatus illustrated in FIG. 2, there is illustrated a plural color electrographic recording apparatus 100. The apparatus 100 includes a plurality of (four are illustrated but more or less may be provided) electrographic single color image recording stations 101K, 101C, 101M, 101Y. Each station is adapted to record and develop a single electrographic toned image thereon and to transfer same to a receiver sheet 133 that is advanced from one color image recording station to another. Discussion will be made only with reference to the first station 101K (black, for example), it being understood that the operation of the other stations (cyan, magenta and yellow) is similar. An advantage of the apparatus of FIG. 2 is that recording may be done at each station while a receiver sheet is not receiving transfer of an image at that station. Such transfer or movements of the receiver sheet into and out of transfer relationship may affect image recording quality as an image is being recorded. The apparatus also provides a straight paper path which is an advantage. In operation of the station, an AC charger 111 neutralizes any charge on the surface of primary imaging member 105. The imaging member 105 is of similar mechanical and electrical characteristics as imaging member 5 of FIG. 1 and includes a conductive support roller 150 preferably grounded, a bi-layer 110 comprising a compliant electrically resistive first layer 117 and a thin dielectric outer layer 118. The thickness and electrical and mechanical properties of roller 150, and layers 117 and 118 are similar to that described above for imaging member 5 of FIG. 1. The writer 112 is similar to that of writer 12 and records on the surface of layer 118 a latent electrostatic image of the black color separation record or, alternatively if a black image only is to be recorded, only the data for recording this image. The latent electrostatic image is preferably a halftone. A black toning station (K) develops this latent image and it is transferred to receiver sheet 133 which has been advanced in timed registered relationship with the image into nip 148 formed between imaging member 105 and transfer member 108. Transfer member 108 is of similar construction to that of receiver support drum 8 of FIG. 1 and includes a support roller 130 that is electrically biased by a power supply of a polarity to attract toner to the receiver sheet 133 which engages the resistive layer 131 on the surface of support roller 108. After transfer of a toned image to receiver sheet 133, the rotation of imaging member 105 causes the surface thereof to be passed beneath a cleaning station 113 where nontransferred toner is removed and the surface cleaned so that the imaging member after again passing beneath AC neutralizing charger is now in condition for recording of a next image record. The receiver sheet with the black color record is then passed to the cyan imaging station (C) where the cyan color record is recorded and transferred in registration to receiver 133 and so on similarly for the recording and transfers of the magenta (M) and yellow (Y) color records. Thereafter, the receiver sheet is input into a fusing station 160 wherein the four or fewer registered images are fixed. The synchronizing of the various operations is provided by suitable controls well known in the art since this general type of color recording apparatus; i.e. use of four color stations, is known particularly for recording using electrophotography.

Figure 3:
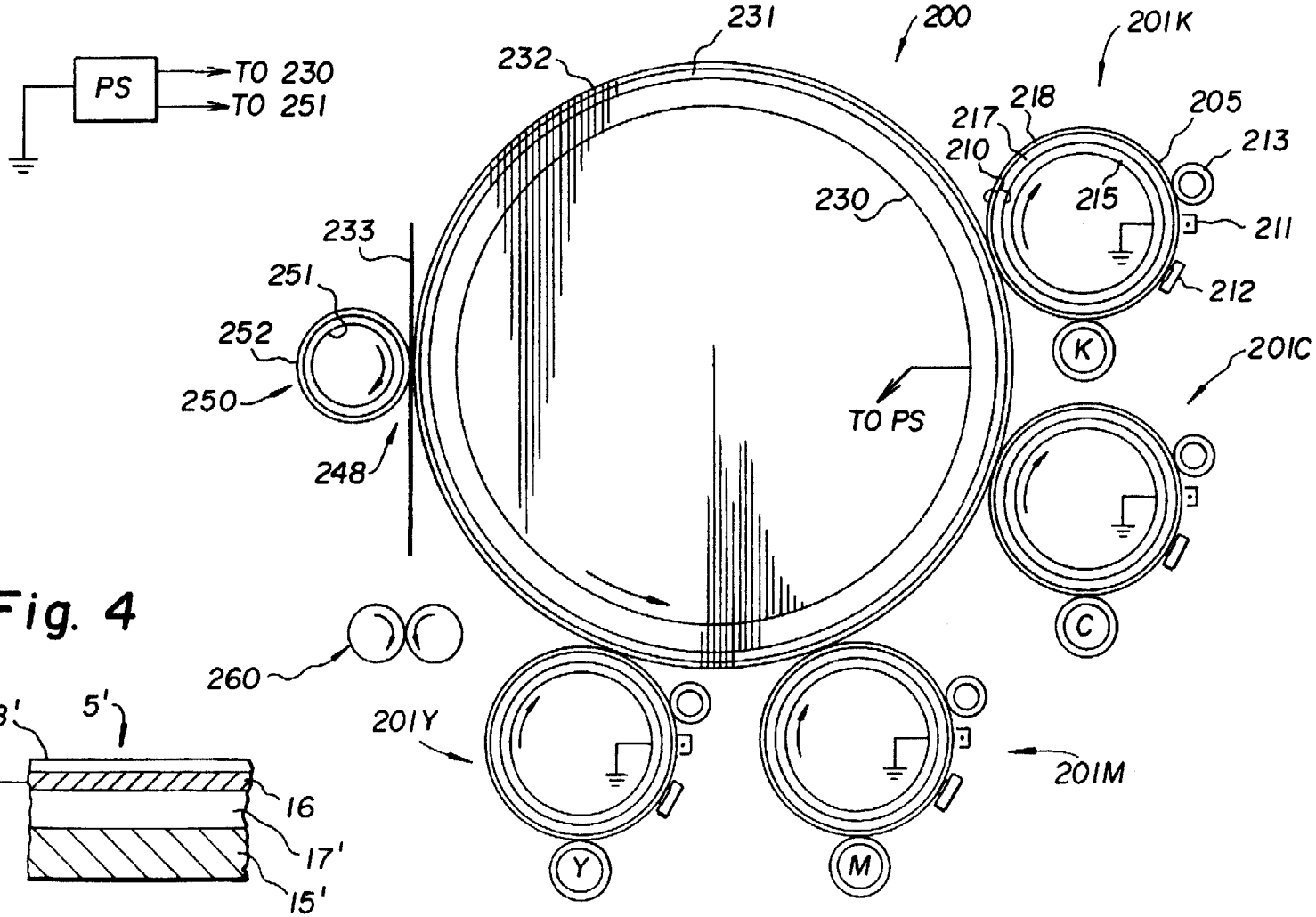
FIG. 3 is a schematic of a third multicolor electrographic recording apparatus in accordance with a third embodiment of the invention.

With reference to FIG. 3, there is illustrated a schematic of another embodiment of the invention. In the embodiment of FIG. 3 there is illustrated a plural color electrographic recording apparatus 200 including four single color electrographic recording stations 201K, 201C, 201M, and 201Y, the order of which may be different for different machines. Each station is adapted to record and develop a single electrographic toned color separation or complete single color image thereon and to transfer same to a common intermediate transfer member 208 which may be a drum as shown or a web. In the case of color separation images, the color separation images are transferred in register to the surface of member 208 to form a multicolor image thereon and then the multicolor image is transferred to a receiver sheet 233 that is moved in registered relationship with the multicolor image on the member 208 into a nip 248 between the intermediate transfer member 208 and a transfer sheet backing roller 250. Discussion will be made only with reference to the first station 201K (black, for example) it being understood that the operation of each of the other stations (cyan, magenta and yellow) is similar.

The station 201K includes a neutralizing AC charger 211, a writer 212, and a black toning or development station (K). The charger, writer and development station are situated about the primary electrographic imaging member 205 and operative to record a latent, preferably halftone, electrostatic color separation image or complete image on the surface of member 205 and to develop same. Member 205 is similar to the primary imaging members described above and includes a conductive support roller 215, preferably grounded, a bilayer 210 comprising a compliant electrically resistive first layer 217 and a thin dielectric outer layer 218. The imaging member 205 is in engagement with or moved into engagement with an intermediate transfer member to transfer the developed image formed on the layer 218 to the surface of the intermediate transfer member.

The intermediate transfer member includes a support and if in the form of a drum, the support is a conductive roller 230 and core that is electrically biased by a voltage from a source of electrical potential (PS) or power supply to attract toner from the developed image on layer 218 to an outer surface of layer 232 formed on the intermediate transfer member. The intermediate transfer member includes a compliant layer supported on the core 230. The compliant layer 231 preferably has a thickness has a thickness of between about 1 mm and about 20 mm and formed of a material having a Young's modulus of between about 0.1 MPa and about 100 MPa, and a resistivity of between about $10^6$ ohm-cm and about $10^{12}$ ohm-cm and preferably a resistivity of between about $10^8$ ohm-cm and $10^{11}$ ohm-cm. The compliant layer is covered with a relatively hard outer layer or skin 232 of thickness between about 1 μm and about 30 μm and hardness greater than about 80 MPa and greater than that of the compliant layer 231. The resistivity of the skin is equal to or greater than that of layer 231.

The developed color separation images are separately transferred in register to an intermediate transfer member. A transfer sheet 233 is then moved into registered transfer relationship with the multicolor developed image on the intermediate transfer member to transfer the multicolor image to the receiver sheet. The receiver sheet during transfer moves within nip 248 and is supported by transfer backing roller 250. The backing roller is urged under relatively high force to provide pressure to the receiver sheet in the nip area. In this regard, reference is made to Zaretsky, U.S. Pat. No. 5,187,526. The transfer backing roller 250 includes a conductive core 251 and a resistive layer 252 supported on the core and having a resistivity in the range of about $10^6$ ohm-cm to about $10^{12}$ ohm-cm and preferably of about $10^8$ to about $10^{11}$ ohm-cm. The conductive core 251 is connected to and suitably biased by a source of potential or power supply (PS) to provide electrostatic attraction of toner from the intermediate transfer member to the receiver sheet 233. Different electrical biases are provided by the power supply to the intermediate transfer member and the transfer backing roller.

Figure 4:
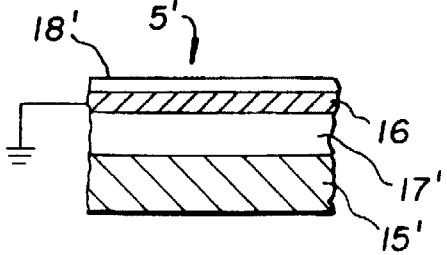
FIG. 4 is a schematic of a portion of a modified primary electrographic imaging member in accordance with the invention and particularly suited for use in the embodiments of FIGS. 1, 2 and 3.

With reference now to FIG. 4, there is shown a schematic (not to scale) of a portion of another embodiment of a primary electrographic imaging member 5' wherein there are at least three layers formed upon the support member 15'. This embodiment of a primary imaging member is the more preferred embodiment. The primary imaging member of the embodiment of FIG. 4 may be used in the apparatus described in FIGS. 1–3. In the embodiment of FIG. 4, the support member 15' need not be conductive. Formed upon the support layer 15' is a compliant first layer 17'. Layer 17' is of similar mechanical characteristics as that described above for layer 17 except that layer 17' need not have any constraint as to electrical resistivity and may be substantially insulative (dielectric) or conductive or with any resistivity. Coated upon compliant layer 17' is a thin conductive coating of metal or other highly conductive material such as of aluminum, nickel or carbon. The thickness of this conductive layer 16 is preferably no more than 1 μm to allow the roller to retain substantially the compliance of the compliant layer 17'. Coated upon the conductive layer 16 is a thin dielectric layer 18' which has all the characteristics of the second layer 18 described above. The advantage of the imaging member 5' is that the electrical resistivity constraint expressed by equation (8) no longer applies so that a simpler and cheaper compliant layer 17' can be used. Moreover, because the grounded layer 16 is very close to the outer surface of layer 18', the problem of interpixel crosstalk during writing is very much reduced or eliminated.

While some electrographic processes as described above combine toner images made originally with different color toners and usually these processes provide two or more different colors to an image, they can also provide images with the same color toners but with different noncolor characteristics. For example, a multiple toner image combining a nonmagnetic black toner and a magnetic black toner would also be a "combined" toner image. In addition, the apparatus 1 may be used to print monocolor images in any of the colors of the four color stations or other accent color stations may be added.

The electrical conductivities of the layers on the write drum 5 and 5' are very different from the electrical properties of the layers on an intermediate transfer drum such as described, for example, by Zaretsky, U.S. Pat. No. 5,187,526 (1993) and by Rimai et. al., U.S. Pat. No. 5,084,735 (1992). An intermediate transfer drum is used to receive from an imaged and developed photoconductor one or more toner images which are subsequently transferred sequentially, or simultaneously, from the intermediate member to paper.

It is stressed that the electrical and surface chemical properties of the preferred write drums of the invention are optimized for transfer to paper or to an intermediate transfer member. On the other hand, the electrical and surface chemical properties of a transfer intermediate member in conventional electrophotography is primarily co-optimized for transfer from a photoconductor to the intermediate member and for transfer from the intermediate member to a receiver. The electrographic write drum, as a primary imaging member, serves a fundamentally different purpose than that of an intermediate transfer member. It is preferred that the surface energy of the write drum be very low, so that the force of adhesion of toner particles to the surface of the write drum is very low to optimize transfer to the receiver. On the other hand, a low surface energy is not desirable on an intermediate transfer member in conventional electrophotography. Moreover, according to the present invention and with regard to the first described embodiments, the compliant layer on the electrographic primary image member of the invention must be very conductive, and much more conductive than a compliant layer used on an intermediate transfer drum. When the primary imaging member shown in FIG. 4 is used, the compliant layer need not be conductive.

The various drums illustrated herein may instead be in the form of webs. Where pressure is required, a backing member or roller may be used to urge the web into pressure engagement with another member.

Because the primary electrographic image member 8 of the invention is compliant, it can provide electrostatic transfer advantages, especially when transferring to a non-compliant member such as a hard intermediate member or a hard receiver (for example, glass metal or paper). When transferring directly to paper or other hard surfaces, a "microconformance" is provided by the effective compliance of the multilayer structures of the invention. This ensures thorough toner-paper contact which helps provide efficient transfer. It also helps transfer in the vicinity of carrier particles and other debris that occasionally are present in the transfer nip, and greatly reduces "hollow character" problems in such transfer. When used for full color reproductions, the microconformance helps provide such contact despite substantial variation in toner stack height typical of multiple color images. Thus, a compliant primary electrographic image member of the invention has general use in electrostatic transfer to a variety of materials comprising the receiver sheet and to a variety of intermediates.

The invention has been described in detail with particular reference to preferred embodiments thereof, but it will be understood that variations and modifications can be effected within the spirit and scope of the invention as described hereinabove and as defined in the appended claims.

We claim:

1. An electrographic primary imaging member upon which an electrographic image may be written by a writer, the imaging member comprising:

a support member;

a charge retention layer for the electrographic image;

a compliant layer formed on the support member as an intermediate layer between the charge retention layer and the support member, the compliant layer being formed of a material having a Young's modulus of between about 0.1 MPa and about 100 MPa and a thickness of between at least 1 mm and about 20 mm; and the charge retention layer being a dielectric and being substantially thinner than the compliant layer and being supported on the support member and having a Young's modulus of greater than that of the compliant layer and at least about 80 MPa.

2. The imaging member of claim 1 wherein a conductive layer is provided between the compliant layer and the charge retention layer.

3. The imaging member of claim 2 wherein the thickness of the charge retention layer is between about 5 μm and about 50 μm.

4. The imaging member of claim 3 wherein the compliant layer has a thickness of between about 3 mm and about 10 mm.

5. The imaging member of claim 4 wherein the compliant layer is formed of a material having a Young's modulus of between about 0.5 MPa and about 5 MPa.

6. The imaging member of claim 1 wherein the resistivity of the compliant layer is less than about $6\times10^6$ ohm-cm.

7. The imaging member of claim 6 wherein the resistivity of the charge retention layer is at least $1.9\times10^{13}$ ohm-cm.

8. The imaging member of claim 6 wherein the thickness of the charge retention layer is between about 5 μm and about 50 μm.

9. The imaging member of claim 6 wherein the compliant layer has a thickness of between about 3 mm and about 10 mm.

10. The imaging member of claim 1 wherein the compliant layer has a thickness of between about 3 mm and about 10 mm.

11. The imaging member of claim 1 wherein the compliant layer is formed of a material having a Young's modulus of between about 0.5 MPa and about 5 MPa.

12. An electrographic recording apparatus comprising:

a primary electrographic imaging member including a support member, a charge retention layer for an electrographic image, a compliant layer formed on the support member as an intermediate layer between the charge retention layer and the support member, the compliant layer being formed of a material having a Young's modulus of between about 0.1 MPa and about 100 MPa and a thickness of between at least 1 mm and about 20 mm, the charge retention layer being a dielectric and being substantially thinner than the compliant layer and also being supported on the support member and having a Young's modulus of greater than that of the compliant layer and at least about 80 MPa;

an electrographic writer forming an electrostatic latent image on the imaging member;

a development station for developing the electrostatic latent image on the imaging member; and a transfer member arranged to provide transfer of the toner image from the primary imaging member.

13. The apparatus of claim 12 wherein the primary imaging member includes a conductive layer provided between the compliant layer and the charge retention layer.

14. The apparatus of claim 13 wherein the transfer member is an intermediate transfer member.

15. The apparatus of claim 13 wherein the transfer member is a receiver sheet backing member and forms a nip with the primary imaging member for receiving a receiver sheet in the nip.

16. The apparatus of claim 15 wherein the thickness of the charge retention layer is between about 5 μm and about 50 μm.

17. The apparatus of claim 15 wherein the compliant layer has a thickness of between about 3 mm and about 10 mm.

18. The apparatus of claim 17 wherein the compliant layer is formed of a material having a Young's modulus of between about 0.5 MPa and about 5 MPa.

19. The apparatus of claim 18 wherein the receiver sheet backing member has a resistivity of between about $10^6$ and about $10^{12}$ ohm-cm.

20. The apparatus of claim 12 wherein the resistivity of the compliant layer is less than about $6\times10^6$ ohm-cm.

21. The apparatus of claim 20 wherein the compliant layer has a thickness of between about 3 mm and about 10 mm.

22. The apparatus of claim 12 wherein the compliant layer is formed of a material having a Young's modulus of between about 0.5 MPa and about 5 MPa.

23. An electrographic recording method comprising:

forming an electrostatic latent image on an electrographic primary imaging member, the imaging member including a support member, a charge retention layer for an electrographic image, a compliant layer formed on the support member as an, intermediate layer between the charge retention layer and the support member, the compliant layer being formed of a material having a Young's modulus of between about 0.1 MPa and about 100 MPa and a thickness of between at least 1 mm and about 20 mm, the charge retention layer being a dielectric and substantially thinner than the compliant layer and supported on the support member and having a Young's modulus of greater than that of the compliant layer and at least 80 MPa;

developing the electrostatic latent image with toner; and transferring the developed image from the primary imaging member.

24. The method of claim 23 wherein a grounded conductive layer is provided between the compliant layer and the overcoat layer.

25. The method of claim 23 wherein plural developed color toner images are formed on the primary imaging member.

26. The method of claim 23 wherein there are plural primary imaging members and each records a developed color image and transfers the developed color images to another member.

27. The method of claim 23 wherein the image is developed with toner particles that have a volume weighted average of less than 6 μm.

* * * * *